US006784836B2

(12) United States Patent
Kasperkovitz et al.

(10) Patent No.: US 6,784,836 B2
(45) Date of Patent: Aug. 31, 2004

(54) METHOD AND SYSTEM FOR FORMING AN ANTENNA PATTERN

(75) Inventors: Wolfdietrich Georg Kasperkovitz, Waalre (NL); Lukas Leyten, Eindhoven (NL); Nunziatina Mezzasalma, Comiso (IT); Cicero Silveira Vaucher, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 59 days.

(21) Appl. No.: 10/128,817

(22) Filed: Apr. 24, 2002

(65) Prior Publication Data

US 2003/0006933 A1 Jan. 9, 2003

(30) Foreign Application Priority Data

Apr. 26, 2001 (EP) ..... 01201522

(51) Int. Cl.[7] ..... H01Q 3/22
(52) U.S. Cl. ..... 342/368; 342/442
(58) Field of Search ..... 342/368, 372, 342/383, 442

(56) References Cited

U.S. PATENT DOCUMENTS

| | | | | |
|---|---|---|---|---|
| 3,036,210 A | | 5/1962 | Lehan et al. | |
| 4,638,320 A | * | 1/1987 | Eggert et al. | 342/442 |
| 4,796,031 A | * | 1/1989 | Koki | 342/148 |
| 4,845,502 A | * | 7/1989 | Carr et al. | 342/430 |
| 4,939,791 A | * | 7/1990 | Bochmann et al. | 455/276 |
| 5,493,307 A | * | 2/1996 | Tsujimoto | 342/380 |
| 5,581,620 A | | 12/1996 | Brandstein et al. | 381/92 |
| 5,736,956 A | * | 4/1998 | Kennedy et al. | 342/90 |
| 6,011,513 A | | 1/2000 | Wilson et al. | 342/372 |
| 6,101,399 A | | 8/2000 | Raleigh et al. | 455/561 |

* cited by examiner

*Primary Examiner*—Dao Phan

(57) ABSTRACT

In an electronic circuit for forming an antenna pattern, the antenna signals having the required phase shift are generated by means of two phase-locked loops which have a common reference signal. A control current, which is added at the output node of the charge pump 26 and/or 27, is used to control the phase shift of the antenna signals. This allows the implementation of the phase shift operation in the analog domain, which decreases the cost of a corresponding consumer device, such as a car-radio or a mobile communication system.

13 Claims, 9 Drawing Sheets

METHOD AND SYSTEM FOR FORMING AN ANTENNA PATTERN

BACKGROUND OF THE INVENTION

1. Field of the Invention

The present invention relates to a method and system for forming an antenna pattern, and more particularly, to the field of beam forming circuitry for antennas.

2. Description of the Related Art

Many communication systems, such as wireless communication systems, radar systems, sonar systems and microphone arrays, use beam forming to enhance the transmission and/or reception of signals. In contrast to conventional communication systems that do not discriminate between signals based on the position of the signal source, beam-forming systems are characterized by the capability of enhancing the reception of signals generated from sources at specific locations relative to the system.

Generally, beam-forming systems include an array of spatially distributed sensor elements, such as antennas, sonar phones or microphones, and a data processing system for combining signals detected by the array. The data processor combines the signals to enhance the reception of signals from sources located at selected locations relative to the sensor elements. Essentially, the data processor "aims" the sensor array in the direction of the signal source.

U.S. Pat. No. 5,581,620 shows a corresponding signal processor that can dynamically determine the relative time delays between a plurality of frequency-dependent signals. The signal processor can adaptively generate a beam signal by aligning the plural frequency-dependent signals according to the relative time delays between the signals.

Within wireless communication systems, such as wireless mobile communication systems, directive antennas can be employed at base station sites as a means of increasing the signal level received by each mobile user relative to the level of received signal interference. This is effected by increasing the energy radiated to a desired recipient mobile user, while simultaneously reducing the interference energy radiated to other remote mobile users.

U.S. Pat. No. 6,101,399 shows a method for forming an adaptive phase array transmission beam pattern at a base station. This method relies on estimating the optimum transmit antenna beam pattern based on certain statistical properties of the received antenna array signals. The optimum transmit beam pattern is found by solving a quadratic optimization subject to quadratic constrains.

U.S. Pat. No. 6,011,513 shows a beam-forming circuitry utilizing PIN diodes. The PIN diode circuit arrangement comprises a digital-to-analog converter with a reference voltage controller arranged to vary the converter's response to digital input signals to compensate for the PIN diodes non-linear response.

"A digital adaptive beam forming QAM demodulator IC for high-bit-rate wireless communications" J-Y Lee, H-C Liu and H. Samueli, IEEE Journal of Solid-State Circuits, March 1998, pp. 367–377, discloses a method for adaptive beam forming in conjunction with frequency hopping. By comparing the beam form data with a reference signal or a training sequence, the receiving pattern converges to the desired result, steering the main beam toward the target user while simultaneously placing nulls in the interferers' directions. The applications for the transceiver include notebook computer communications, portable multimedia radios and nomadic computing in both cellular and peer-to-peer communication networks. The source directions are assumed unknown a priori. Further, the method features real-time tracking capability for the adaptive beam forming.

A common disadvantage of prior art beam forming methods and systems is the expenditure of a dedicated digital signal processing system which is used for the beam forming. This constrains applications of beam forming for consumer devices.

SUMMARY OF THE INVENTION

It is therefore an object of the invention to provide an improved method and electronic circuit for forming an antenna pattern.

It is a further object of the invention to provide a receiver and a transmitter featuring beam forming for application in consumer devices.

The invention provides a cost efficient method and electronic circuit for forming an antenna pattern. This allows for the implementation of beam forming for antennas in consumer devices, such as car-radio receivers with improved multi-path reception, mobile and wireless telephony devices such as GSM, DECT or blue tooth mobile devices with low cost transceivers having beam forming capabilities, as well as for space-time coding applications.

The beam forming capability in the receiver/transceiver system leads to improved RF performance. The basic principle of the beam forming relies on the availability of distinct RF signals coming (going) to two or more antennas. By selectively phase-shifting the RF signals with respect to each other, a programmable antenna pattern results.

For example, the antenna pattern can be adjusted with the objective of:

Cancelling multi-path interference caused by secondary transmission paths. The main lobe of the antenna pattern is adjusted in the direction of the direct reception path and the combined antennas gain in the direction of the reflected beams is minimized; and Providing a means for the implementation of space-time diversity systems. By sending and receiving signals which are "spatially" coded, it is possible to have several devices operating on the same wavelength (e.g., in an office) without severe interference problems. Each transceiver adjusts its "beam direction" to attain the RF link to a desired transceiver "partner".

The invention is advantageous in that it enables implementing the beam forming in the analog domain. This way, the expenditure for digital multipliers and other digital signal processing steps are avoided. In a preferred embodiment, this is accomplished by adding a programmable control current to at least one of the branches of two phase-locked loops in order to produce the required phase shift of the antenna signals.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENTS

Figure 1:
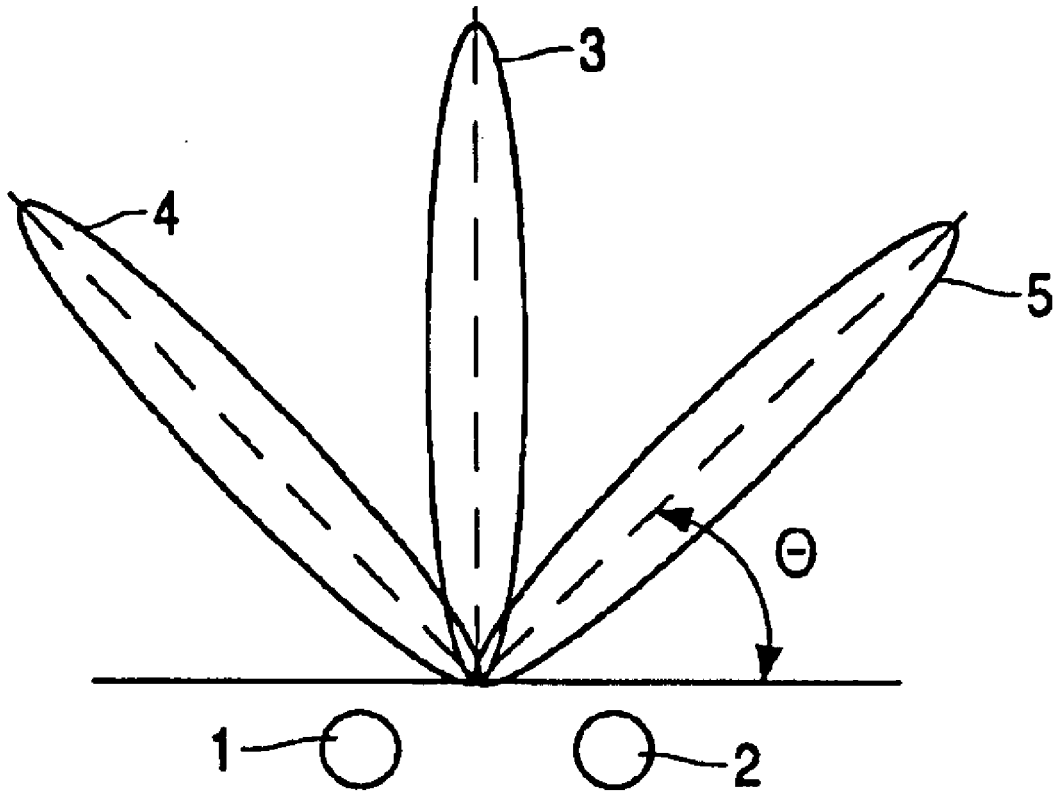
FIG. 1 shows an adaptive antenna pattern of two antennas.

FIG. 1 shows antennas 1 and 2. The antennas 1 and 2 have a resulting antenna pattern 3 if no beam forming is used, or if no phase shift is applied to the respective antenna signals. In the case of beam forming, other antenna patterns 4 and 5 can be produced.

The angle θ of the main lobe of the antenna pattern 5 is determined by the phase shift applied to the respective antenna signals of the antennas 1 and 2. By varying the phase shift, the angle θ varies correspondingly. This way, it is possible to select an arbitrary angle θ for the main lobe of the antenna pattern 5 by making an appropriate choice for the phase shift of the antenna signals.

Figure 2:
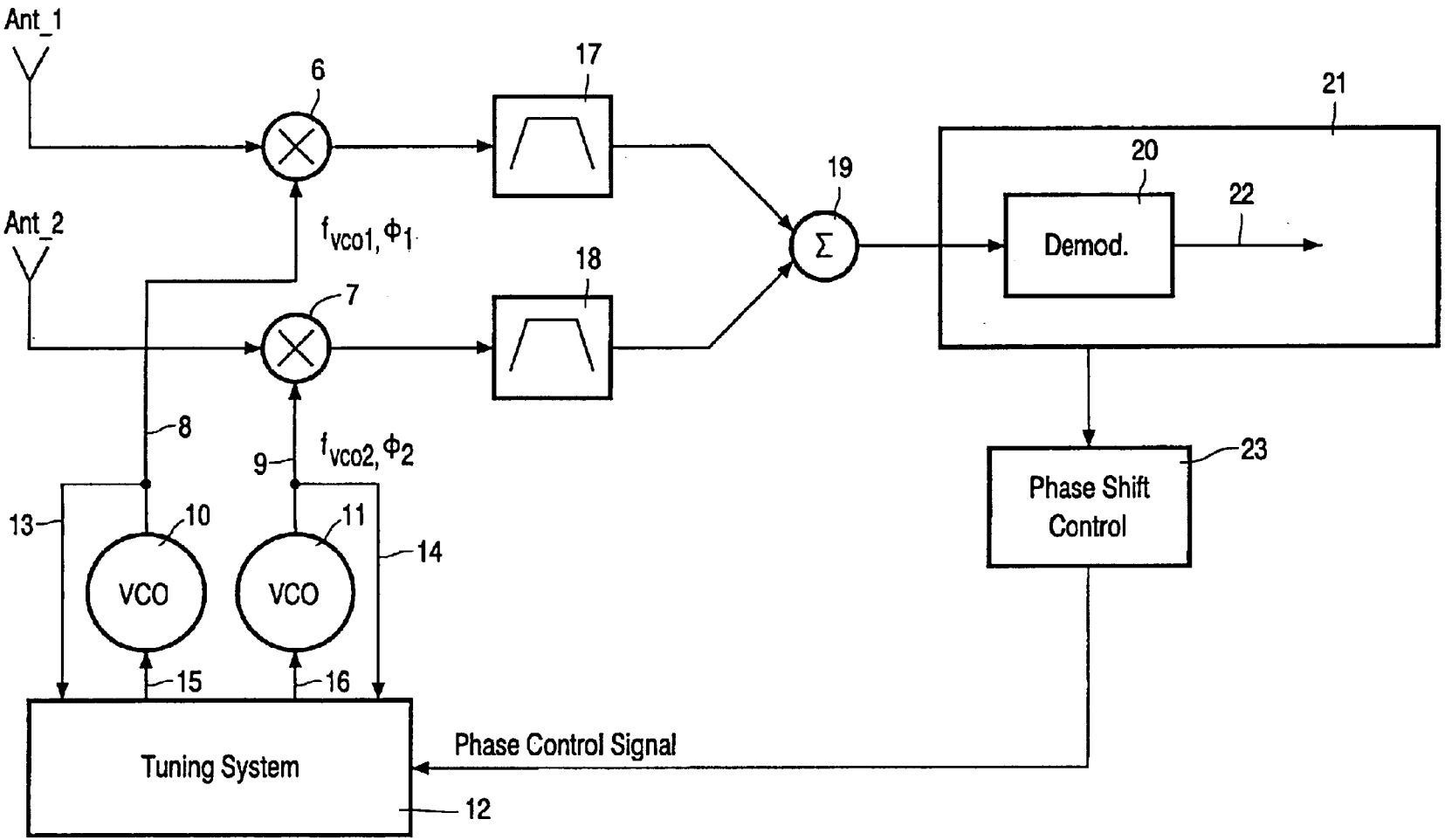
FIG. 2 shows a first embodiment of a receiver in accordance with the invention.

FIG. 2 shows a block diagram of a receiver in accordance with the invention with adaptive beam forming in the analog domain. Signals Ant_1 and Ant_2 are received from the antennas 1 and 2 (cf. FIG. 1), respectively. The antenna signals Ant_1 and Ant_2 are applied to mixers 6 and 7, respectively. Further, a signal 8, having a frequency $f_{vco1}$ and a phase Φ1, is applied to the mixer 6. Likewise, a signal 9, having a frequency $f_{vco2}$ and a phase Φ2, is applied to the mixer 7.

The signals 8 and 9 are outputted by the voltage-controlled oscillators 10 and 11, respectively. The voltage-controlled oscillators 10 and 11 are connected to a tuning system 12. By means of the voltage-controlled oscillator 10, the feedback signal 13 and the tuning system 12, a first phase-locked loop is created.

A separate phase-locked loop is created by the voltage-controlled oscillator 11, the feedback signal 14 and the tuning system 12. The outputs 15 and 16 of the tuning system 12, which are coupled to the voltage-controlled oscillators 10 and 11, respectively, determine the frequencies $f_{vco1}$ and $f_{vco2}$ as well as the phase angles Φ1 and Φ2 of the signals 8 and 9 to which the respective phase-locked loops lock.

The output of the mixer 6 is the signal Ant_1 multiplied by the signal 8, while the output of the mixer 7 is the signal Ant_2 multiplied by the signal 9. The respective outputs of the mixers 6 and 7 are coupled to the filters 17 and 18.

In the example considered here, the filters 17 and 18 are bandpass filters. The outputs-of the filters 17 and 18 are coupled to a combiner 19 for adding the outputs of the filters 17 and 18. The output of the combiner 19 is coupled to a demodulator 20 which forms part of a baseband processing system 21.

The demodulator 20 has an output 22 for outputting the demodulated signal to other components of the baseband processing system 21 (not shown in FIG. 2). The other components of the baseband processing system 21 can comprise a channel decoder, voice decoding and/or other digital signal processing components depending on the application.

A phase shift controller 23 is coupled to the baseband processing system 21. Based on the output 22 of the demodulator 20, the phase shift controller 23 determines the phase shift ΔΦ between the phases Φ1 and Φ2 of the signals 8 and 9 for a desired resulting antenna pattern. The phase shift controller 23 outputs a phase control signal to the tuning system 12 to instruct the tuning system 12 as to which phase shift ΔΦ must be imposed onto the phases Φ1 and Φ2 of the respective output signals 8 and 9 of the voltage controlled oscillators 10 and 11.

The circuit of FIG. 2 does not require digital mixers as the mixing is performed in the analog domain by the mixers 6 and 7. Further, the circuit of FIG. 2 does not require a dedicated processor for generating the signals 8 and 9 with the required phase shift ΔΦ, as these signals are also generated in the analog domain by means of the respective phase-locked loops. This way, the circuit can be realized in an inexpensive way with particular applications for consumer devices.

Figure 3:
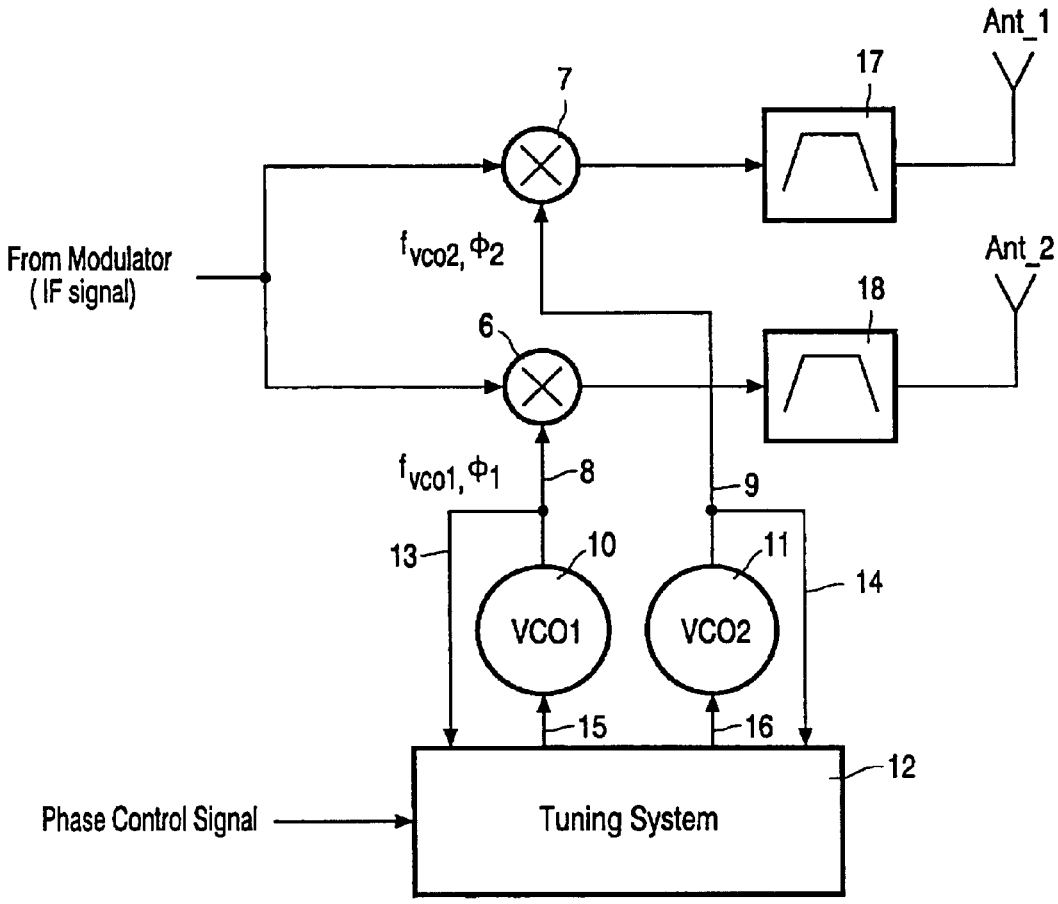
FIG. 3 shows a first embodiment of a transmitter in accordance with the invention.

FIG. 3 shows a transmitter corresponding to the receiver of FIG. 2. Like elements of the receiver of FIG. 3 corresponding to elements of the receiver of FIG. 2 are denoted with the same reference numerals.

An IF signal is generated by a modulator of the baseband processing system and is provided to the respective inputs of the mixers 6 and 7. Further, the mixers 6 and 7 receive the signals 8 and 9 for the purposes of up-conversion of the IF signal. As the signals 8 and 9 have a phase shift of ΔΦ in addition to the up-conversion, a corresponding phase shift between the signals at the outputs of the mixers 6 and 7 results. After filtering by the filters 17 and 18, respectively, corresponding antenna signals result which form a desired antenna pattern in accordance with the phase shift ΔΦ.

The phase shift ΔΦ is determined by a phase control signal applied to the tuning system 12 as explained above with reference to FIG. 2. Again, the phase control signal is produced by a phase shift controller. For example, the phase shift controller can vary the phase shift ΔΦ within a certain range in order to identify an optimal antenna pattern and a corresponding optimal phase shift ΔΦ which is then selected for operation of the system.

Figure 4:
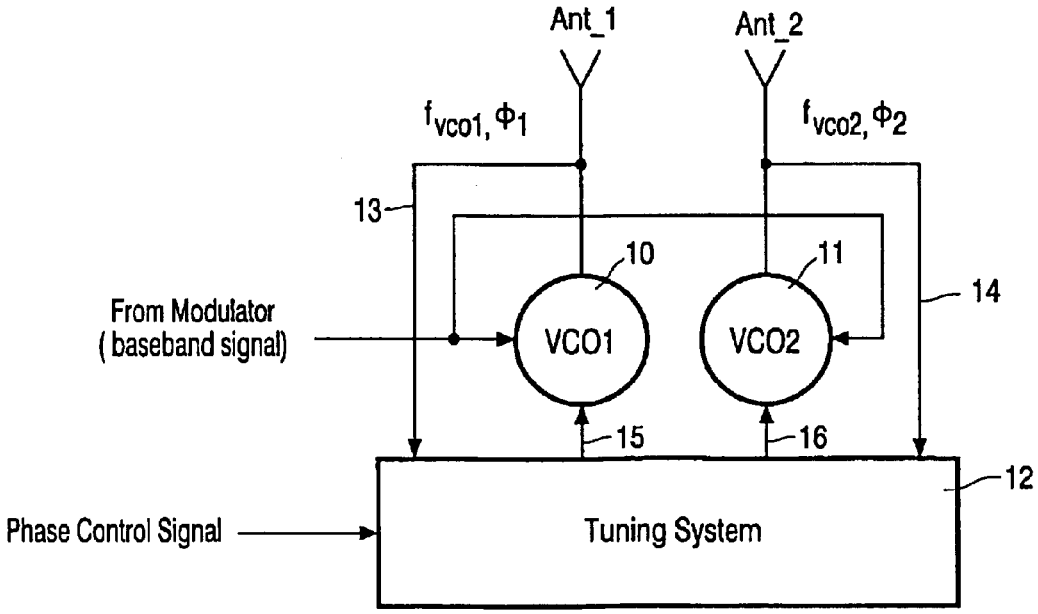
FIG. 4 shows a second embodiment of a transmitter in accordance with the invention.

FIG. 4 shows a further preferred embodiment of a transmitter. Again, like elements are denoted with the same reference numerals. In contrast to the embodiment of FIG. 3, no up-conversion mixing or other mixing is required. Instead, a direct modulation is performed by applying a modulated baseband signal to respective inputs of the voltage-controlled oscillators 10 and 11 to perform a frequency or phase modulation. As a further advantage, the bandpass filters 17 and 18 can be dispensed with.

In the example considered here, the bandwidth of the tuning system 12 is substantially smaller than the symbol rate being transmitted. Further, the scanning frequency of the beam is smaller than the loop bandwidth of the tuning system.

Figure 5:
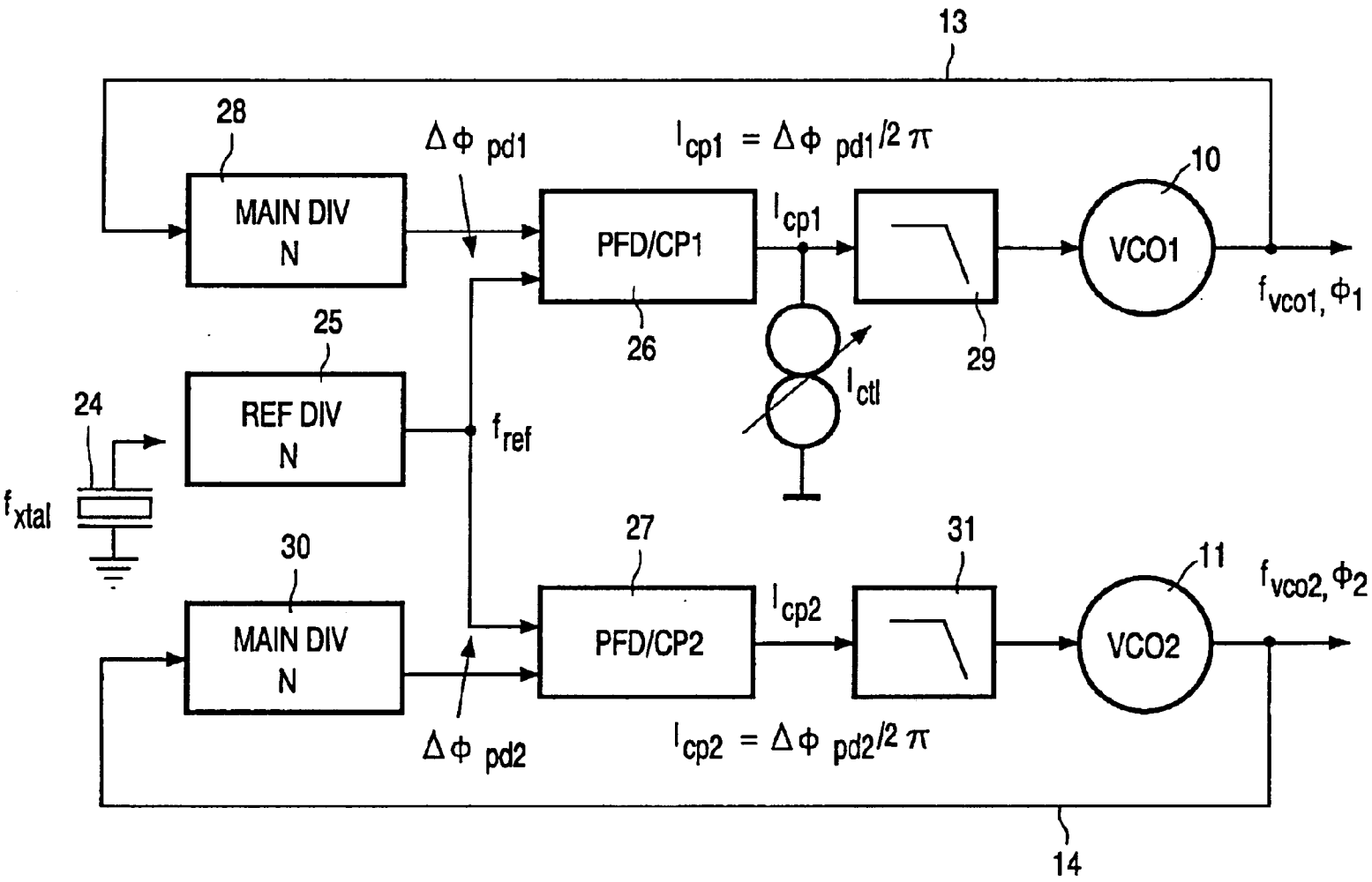
FIG. 5 shows a first embodiment of an electronic circuit in accordance with the invention.

FIG. 5 shows an embodiment of a circuit of the invention. Again, like elements are denoted with the same reference numerals.

The circuit has a quartz oscillator 24 oscillating at a frequency of $f_{xta1}$. The output of the oscillator 24 is frequency divided by R by the frequency divider 25 such that a signal having a reference frequency of $f_{ref}$ results.

The reference signal with the frequency $f_{ref}$ is inputted into the phase frequency detector/charge pump circuits 26 and 27. The circuit 26 receives a further input from the frequency divider 28 which divides the frequency of the output signal $f_{vco1}$ by N.

The phase frequency difference $\Delta\Phi_{pd1}$ of the two signals is detected by the circuit 26. The magnitude of the phase frequency difference $\Delta\Phi_{pd1}$ determines the amount of charge produced by the charge pump of the circuit 26. A suitable charge pump for this application is known from U.S. Pat. No. 5,929,678. The corresponding output current produced by the charge pump of the circuit 26 is denoted $I_{cp1}$ in FIG. 5. The magnitude of the current $I_{cp1}$ is determined by the following equation:

$$I_{cp1}=\Delta\Phi_{pd1}/2\pi \tag{1}$$

The current $I_{cp1}$ is inputted into a filter 29 which contains an integrator. The output of the filter 29 determines the voltage control signal applied to the voltage-controlled oscillator 10 and, thus, determines the frequency $f_{vco1}$. This way, a phase-locked loop, comprising the frequency divider 28, the circuit 26, the filter 29, the voltage-controlled oscillator 10 and the feedback signal 13, results.

When the phase-locked loop is locked, the phase frequency difference $\Delta\Phi_{pd1}$ becomes 0 such that the current $I_{cp1}$ also becomes 0. A corresponding phase-locked loop, comprising a frequency divider 30, the circuit 27, a filter 31, the voltage-controlled oscillator 11 and the feedback signal 14, is established in the circuit of FIG. 5 for the generation of the second signal having the frequency $f_{vco2}$.

With respect to the current $I_{cp2}$ produced by the charge pump of the circuit 27, the above Equation (1) applies analogously where $\Delta\Phi$, in this case, is the phase frequency difference $\Delta\Phi_{pd2}$ of the reference signal and the output signal of frequency divider 30.

The phase shift $\Delta\Phi=\Phi1-\Phi2$ of the signals which are outputted by the voltage-controlled oscillators 10 and 11, is determined by an additional current $I_{ct1}$ which is added at a node between the circuit 26 and the filter 29.

The phase shifting capability implemented with the circuit of FIG. 5 is based on the fact that the phase-locked loop tuning system contains a double integrator in its transfer function. This is also known as a type 2 phase-locked loop. The double integration is used to achieve phase lock of the respective outputs of the voltage-controlled oscillators 10 and 11 to the reference signal with zero residual phase error.

Figure 6:
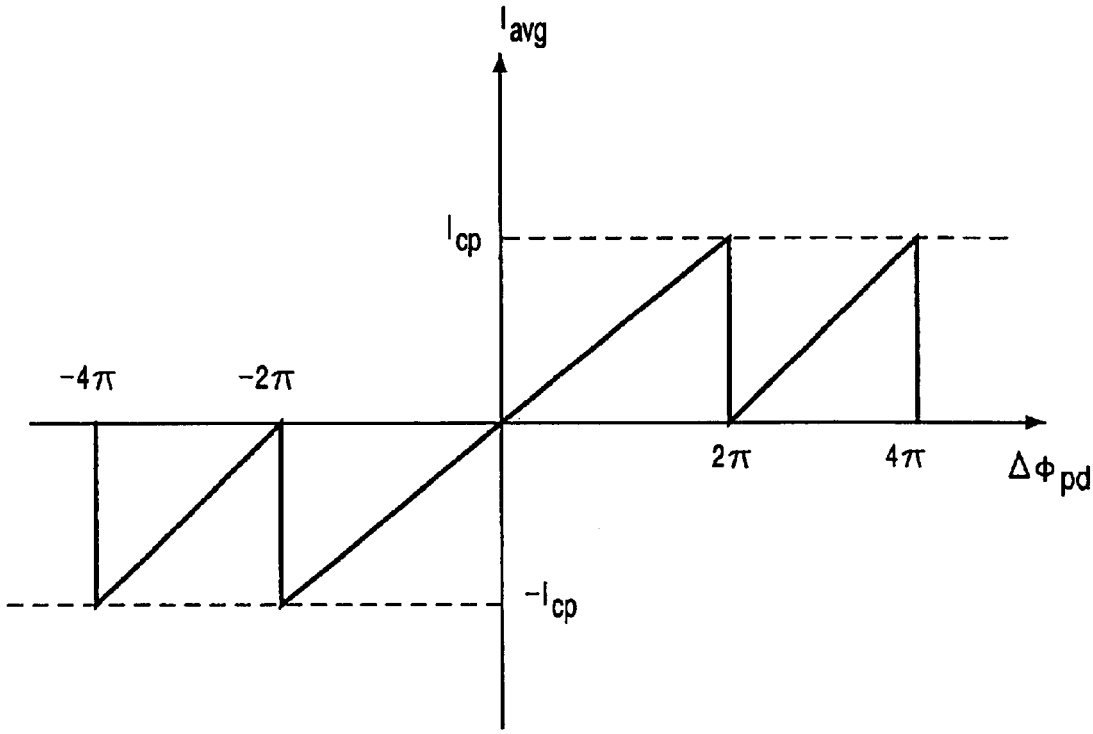
FIG. 6 shows a transfer function of a typical phase frequency detector/charge pump of the circuit of FIG. 5.

Zero phase error leads to minimal reference spurious breakthrough, as the contents of the output signal of the phase frequency detector/charge pump (PFD/CP), i.e., circuit 26 and 27, are minimized. The transfer function of the circuits 26 and 27 is depicted in FIG. 6. For $\Delta\Phi_{pd}=0$, the average output current $I_{avg}$ of the circuit 26 vanishes.

The presence of the integrator in the loop filter itself, combined with the integrating action of the voltage-controlled oscillators, assures that the loop locks at the position where the total current flowing into loop filter is zero. Otherwise, there would be a shift in the loop filters DC voltage, and phase- and frequency lock would eventually be lost. With respect to the control current $I_{ct1}$ which is added at the output node of the circuit 26 in FIG. 5, this means that the corresponding phase-locked loop is locked if the following condition is fulfilled:

$$I_{ct1}+I_{avg}=0 \tag{2}$$

As a consequence, the phase-locked loop locks the frequency divided output signal of the voltage-controlled oscillator 10 to the respective reference signal at a phase $\Delta\Phi_{pd1}$. The relation ship of $I_{ct1}$ and $\Delta\Phi_{pd1}$ is as follows:

$$\Delta\Phi_{pd1}=I_{ct1}*2\pi/I_{cp} \tag{3}$$

The phase shift of the signal which is outputted by the voltage-controlled oscillator 10, is N (which is the divider ratio of the frequency divider 28) times the phase shift $\Delta\Phi_{pd1}$ at the input of the circuit 26. Therefore, the phase shift at the output of the voltage-controlled oscillator 10 is:

$$\Delta\Phi_0=2\pi N/I_{cp}*I_{ct1} \tag{4}$$

Figure 7:
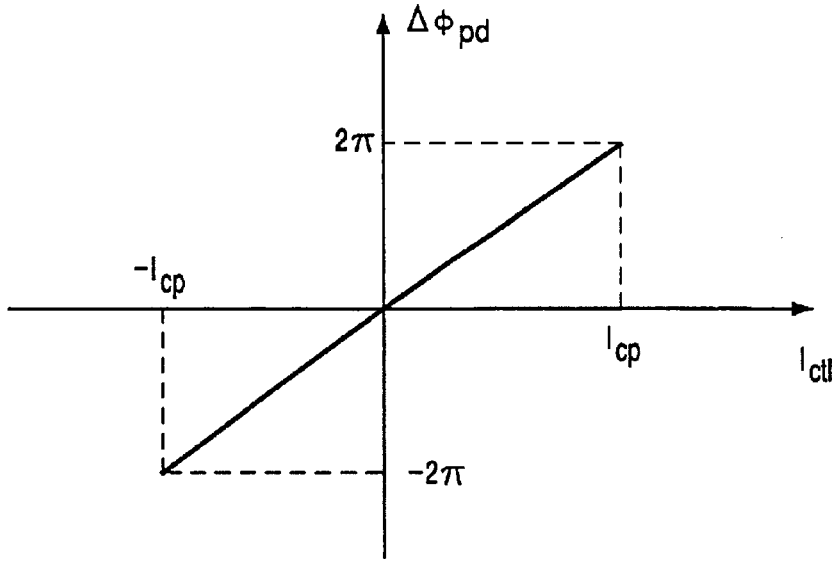
FIG. 7 illustrates the phase shift at the respective inputs of the phase frequency detector as a function of the control current.
Figure 8:
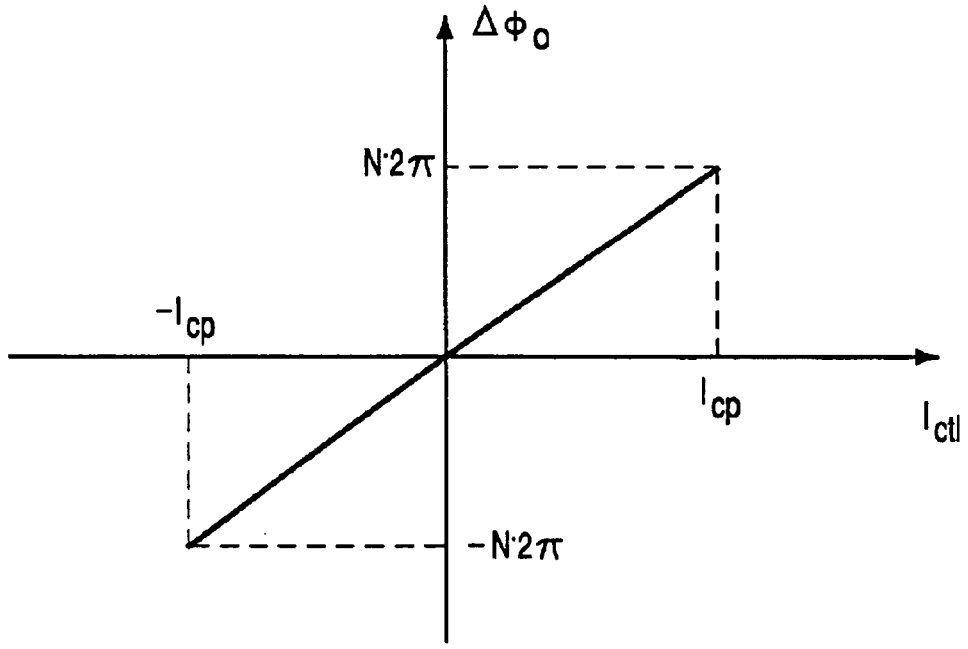
FIG. 8 illustrates the phase shift at the voltage-controlled oscillators of the circuit of FIG. 5 as a function of the control current.

FIG. 6 shows the phase shift $\Delta\Phi_{pd}$ at the input of the circuit 26 as a function of $I_{ct1}$. Likewise, FIG. 7 shows the phase shift $\Delta\Phi_0$ at the output of the voltage-controlled oscillator 10 as a function of $I_{ct1}$ in accordance with above Equation (4). FIG. 6 shows the transfer function of the circuit 26.

It is as such known from the prior art that leakage currents in a phase-locked loop can lead to increased spurious reference breakthrough. This effect is caused by the injection of current from the charge pump into the loop filter, to compensate for the loop filter's lost charge during the previous reference period.

With respect to the circuit of FIG. 5, the phase-locked loop reacts to control the current $I_{ct1}$ exactly in the same way as it does for leakage currents in the tuning line. The relationship between the magnitude of the spurious signals at the fundamental and at multiples of the reference frequency as a function of the control current $I_{ct1}$ is as follows:

$$A_{sp}(n\cdot f_{ref})/A_{I0}=20\log(I_{ct1}|Z_f(n\cdot f_{ref})|K_{vco}/n\cdot f_{ref}) \tag{5}$$

Where |Zf (n·fref)| is the modulus of the trans-impedance of the loop at the reference frequency and harmonics thereof, and $K_{vco}$ is the gain of the voltage controlled oscillator in Hz/V. The required levels of attenuation can be obtained by decreasing the trans-impedance of the loop filter at the relevant offset frequencies.

In view of the above Equation (4), the control current $I_{ct1}$ can be expressed as follows:

$$I_{ct1}=\Delta\Phi_0 I_{cp}/2\pi N. \tag{6}$$

Substitution of a control current $I_{ct1}$ by the expression of Equation (6) in Equation (5) leads to a relationship between the reference breakthrough and the phase shift $\Delta\Phi_0$:

$$A_{sp}(n\cdot f_{ref})/A_{I0}=20\log(\Delta\Phi_0 I_{cp}|Z_t(n\cdot f_{ref})|K_{vco}/(n\cdot f_{ref}2\pi N)) \tag{7}$$

Figure 9:
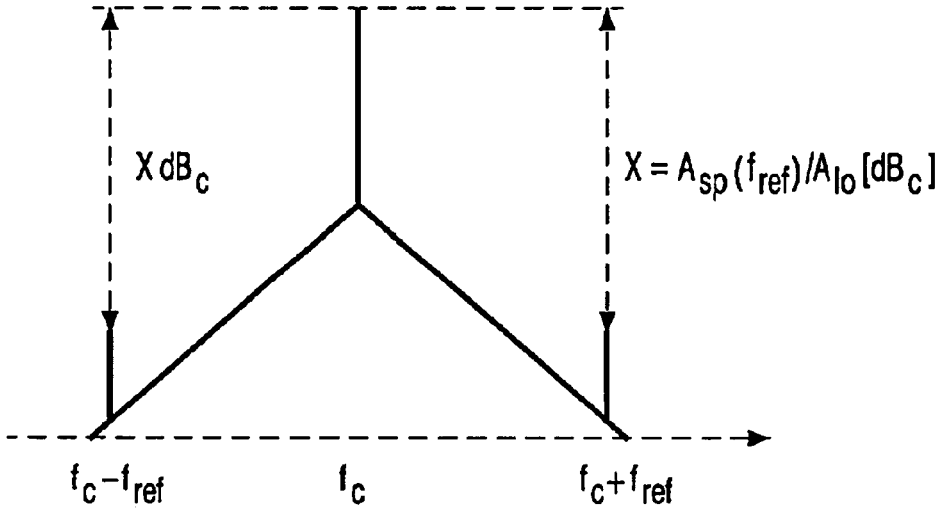
FIG. 9 is a diagram illustrating the reference spurious breakthrough due to the control current.

The reference spurious breakthrough due to the control current $I_{ct1}$ is also illustrated in FIG. 9.

Figure 10:
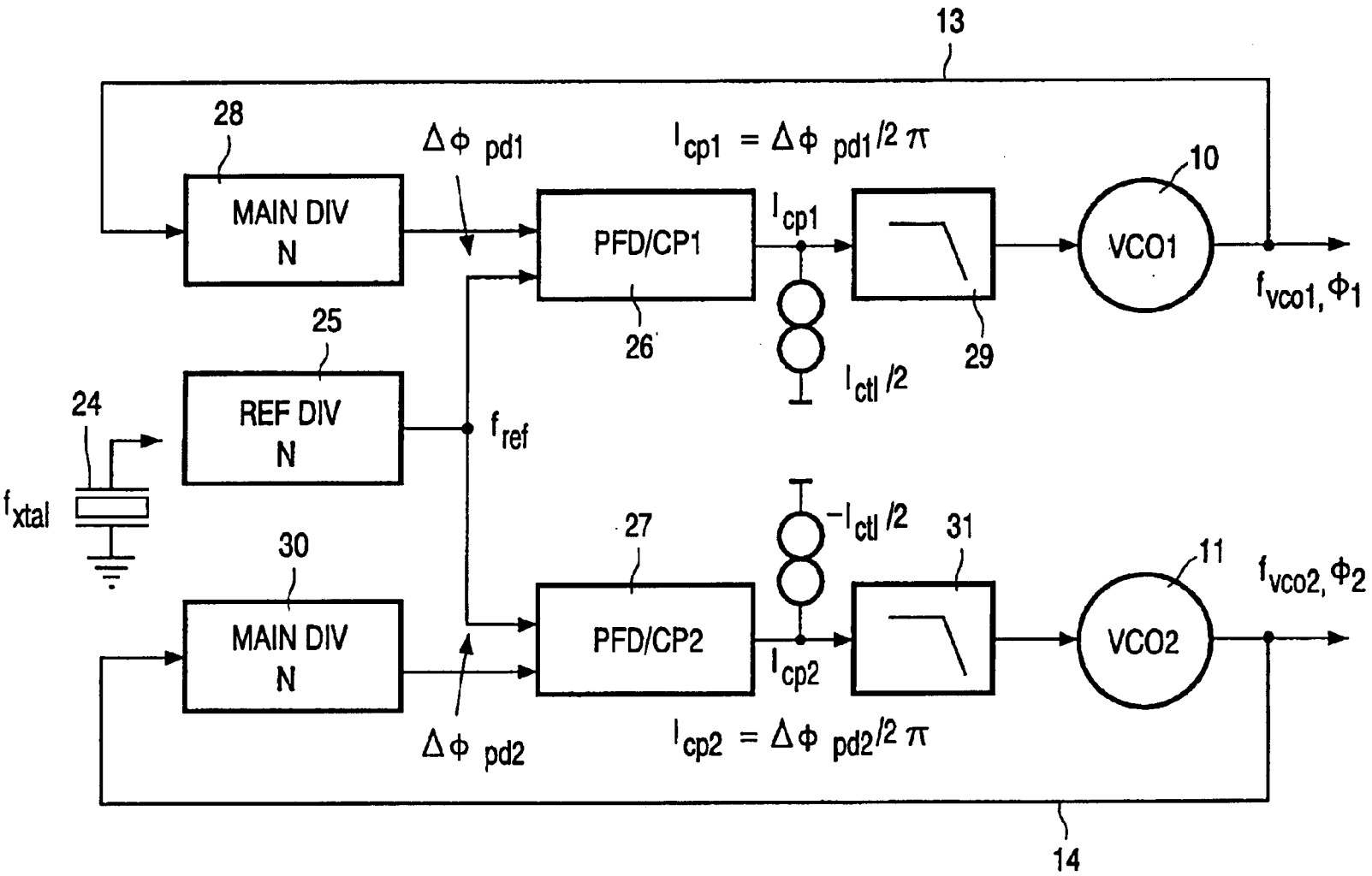
FIG. 10 is a block diagram of a second embodiment of the circuit in accordance with the invention.

From this, it follows that a lower spurious breakthrough level can be reached, on average, by splitting the control current $I_{ct1}$ differentially over the two loops, as it is depicted in the embodiment of FIG. 10. By splitting the control current $I_{ct1}$ this way, the magnitude of the spurious signals decreases by 3 dB with respect to the embodiment of FIG. 5.

In the embodiment of FIG. 10, like elements are denoted with the same reference numerals as the corresponding elements of the embodiment of FIG. 5. The control current $I_{ct1}$ of FIG. 5 is divided into two different currents $I_1=I_{ct1}/2$ and $I_2=-I_{ct1}/2$. The current $I_1$ is added at the output node of the circuit 26 and the current $I_2$ is added to the output node of the circuit 27. The resulting frequencies $f_{vco1}$, $f_{vco2}$ and the phases Φ1, Φ2 of the output signals of the voltage-controlled oscillators 10 and 11 are the same as in the embodiments of FIG. 5, but with a three dB lower magnitude of the spurious signals.

Figure 11:
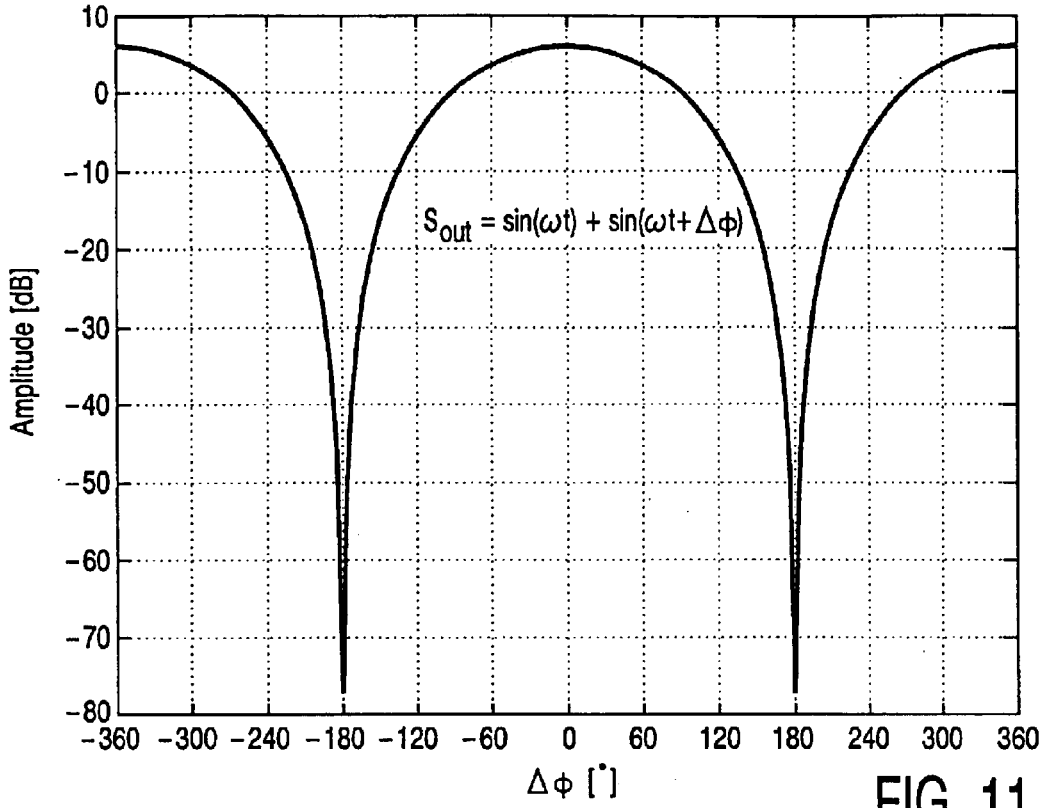
FIG. 11 illustrates an ideal relationship between the phase shift and the amplitude.

For the implementation of the circuit of the FIG. 10, commercially available components can be utilized, such as the SA8016 chip and the Marconi 2042 signal generator. For an experimental validation of the invention, the PLL and the Marconi shared the same 10 MHz reference oscillator signal. Therefore, the Marconi operated synchronized to the PLL, serving as the "second loop" of FIG. 10. The level of the output signal from the Marconi was matched to the level of VCO1. The output signal of the PLL (VCO1) was summed to the signal from the Marconi in a hybrid element. As $I_{ct1}$ was varied, the resulting amplitude of the combined signals was used to assess the phase difference between the Marconi output and the signal supplied by VCO1. When the signals are "in-phase", the resulting signal is 6 dB higher than the individual components. Conversely, when the phases of the signals differ by 180 degree, the resulting signal (ideally) vanishes. The relationship between the phase shift and the resulting amplitude is plotted in FIG. 11, in dB normalized to the amplitude of VCO1.

Figure 12:
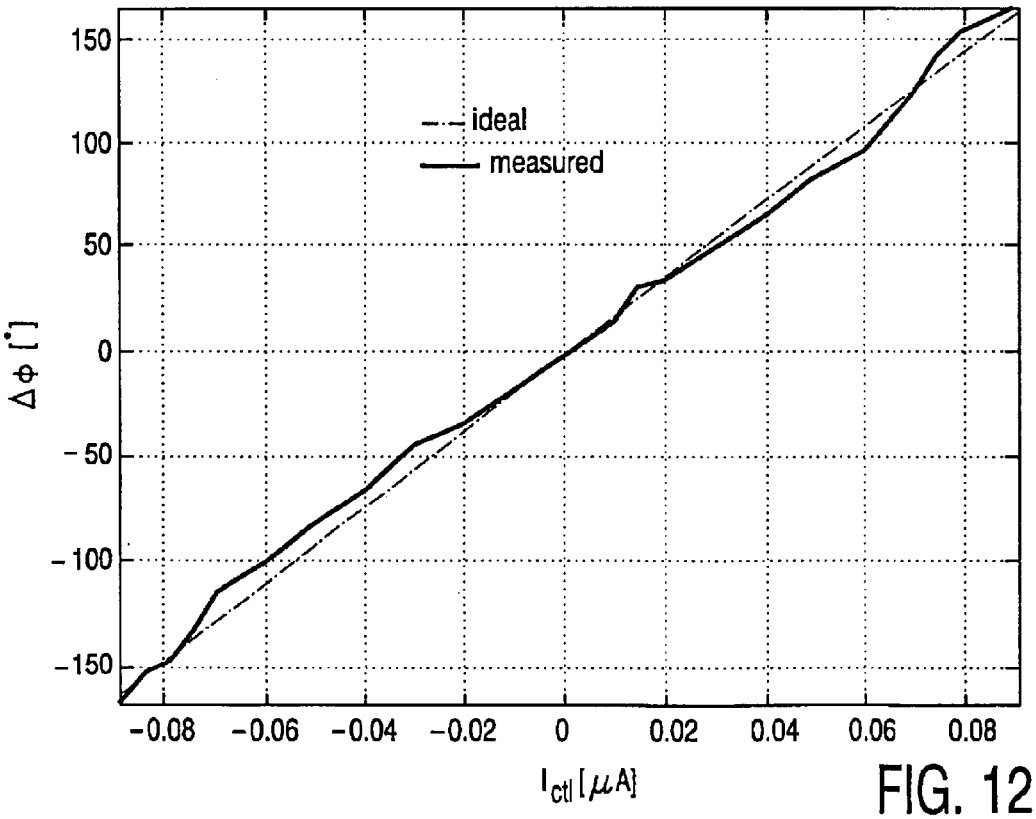
FIGS. 12 and 13 illustrate the phase shift as a function of the control current.
Figure 13:
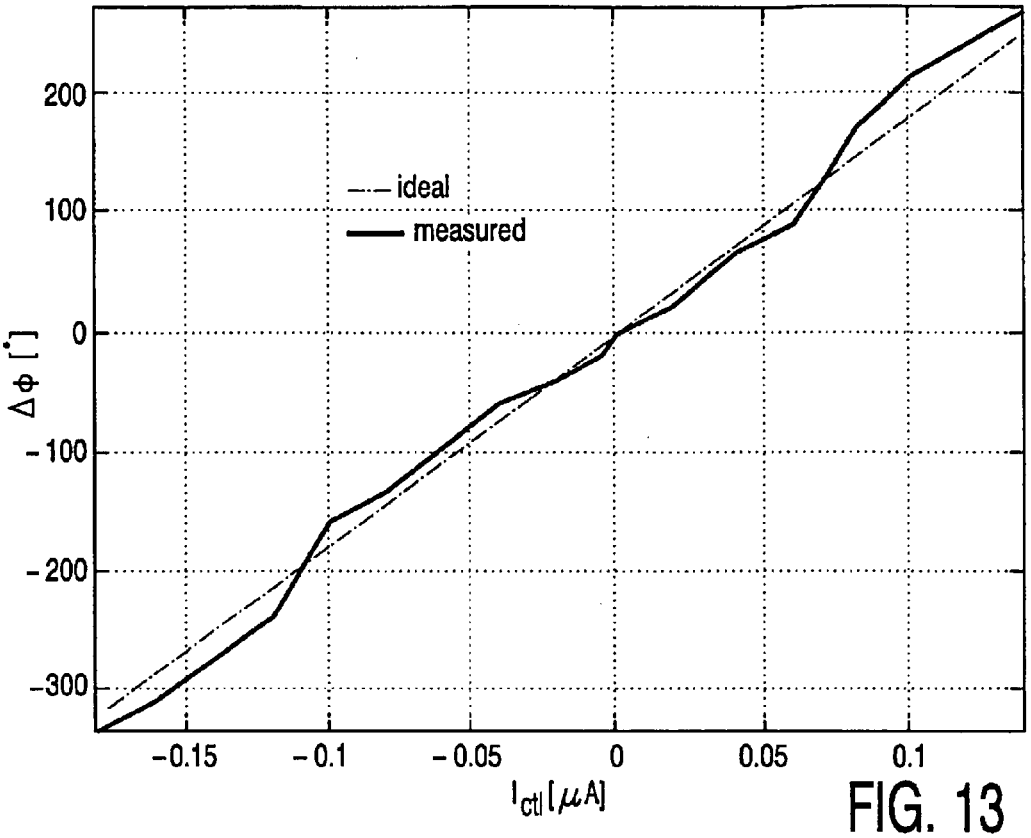

By matching the measured amplitude (amplitude as function of $I_{ct1}$) of the summed signals against a mathematical expression of the amplitude versus ΔΦ, a relationship between ΔΦ and $I_{ct1}$ is indirectly obtained without a need to measure the phase difference directly at RF. The relationship is plotted in FIGS. 12 and 13, against the ideal value calculated from Equation (4).

Figure 14:
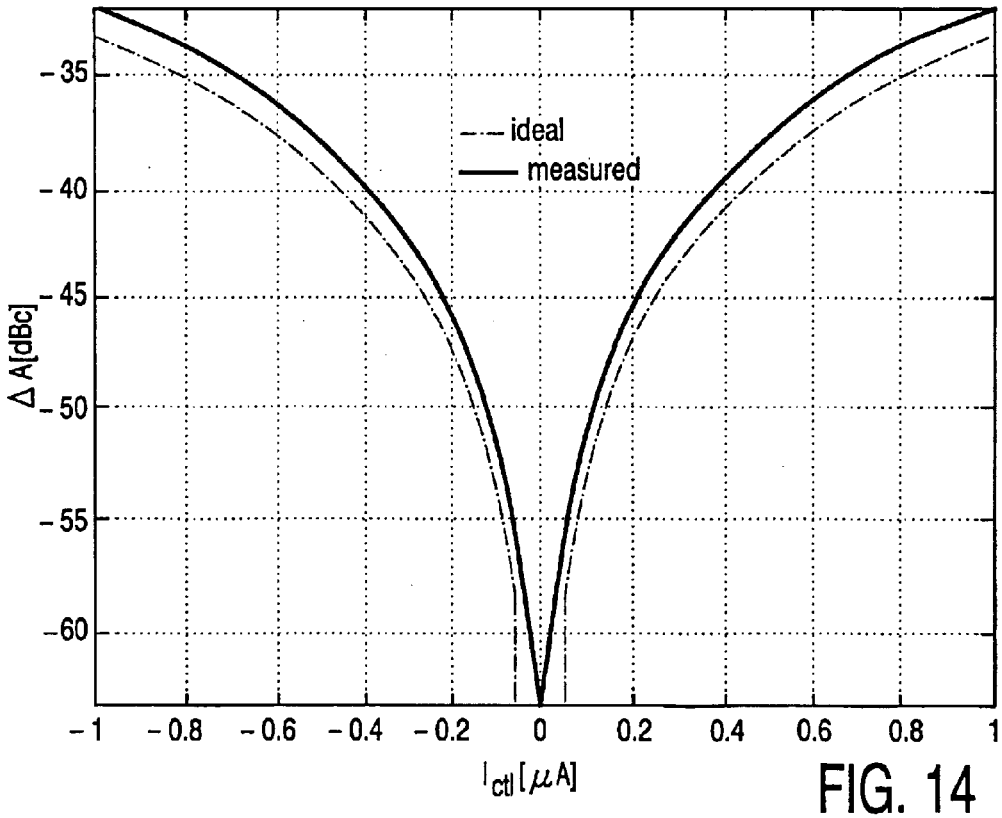
FIG. 14 illustrates the reference spurious breakthrough.

The spurious reference breakthrough at a frequency offset of 1 MHz is plotted in FIG. 14, as a function of the control current $I_{ct1}$. Also plotted is the calculated value obtained by means of Equation (5).

In view of the above, it must be concluded that there is a good agreement between the predicted, theoretical values of the phase shift (i.e., Equation (4)) and spurious reference breakthrough (Equation (5)) with the measured values obtained with the PLL functional model.

The parameters for the PLL were as follows: $F_{cvo}$=2490 MHz, $K_{vco}$=143 MHz/V, $f_{ref}$=1 MHz, N=2490, $I_{cp}$=500 μA, 2nd order loop filter (R=16 kΩ, C1=7.8 nF, C2=1.22 nF).

What is claimed is:

1. An electronic circuit for forming an antenna pattern, the circuit comprising:

a first signal generator for generating a first signal of a first frequency and of a first phase angle, said first signal generator having a first control loop;

a second signal generator for generating a second signal of a second frequency and of a second phase angle, the second frequency being substantially equal to the first frequency, said second signal generator having a second control loop;

a control circuit coupled to said first and second signal generators for controlling a phase difference between the first phase angle and the second phase angle, the control circuit having an input for receiving a control signal for determining the phase difference, at least one of said first and second control loops having an additional input for receiving a control current from said control circuit proportional to said control signal;

a first analog mixer for mixing a first antenna signal and the first signal and a second analog mixer for mixing a second antenna signal and the second signal and a combiner for adding respective output signals of the first and the second mixers.

2. The electronic circuit as claimed in claim 1, the control signal being provided by a baseband processing system.

3. The electronic circuit as claimed in claim 1, wherein the first and the second control loops comprise phase-locked loops.

4. The electronic circuit as claimed in claim 3, wherein the first and the second control loops each comprises a phase frequency detector, a charge pump and a filter with an integrator connected in series, wherein at least one of the first and the second control loops has an input for receiving the control current at a node between the charge pump and the filter.

5. The electronic circuit as claimed in claim 4, wherein the first and the second control loops each comprises an input for receiving a first and a second control current, respectively, from the control circuit, the first and the second control currents being opposite in phase and having substantially the same absolute value.

6. A receiver comprising a first antenna and a second antenna, an electronic circuit for forming an antenna pattern as claimed in claim 1, the first analog mixer being coupled to the first antenna and the second analog mixer being coupled to the second antenna, a baseband processing system having a demodulator-, the demodulator being coupled to an output of the combiner, and a phase shift control coupled to the baseband processing system for generating the control signal for determining the phase difference.

7. The receiver as claimed in claim 6, wherein the phase shift controller varies the control signal in order to identify an optimized antenna pattern for the reception.

8. A transmitter comprising a baseband processing system for providing a baseband signal, the baseband processing system having a phase shift controller for generating a control signal for determining a phase difference, an electronic circuit for forming an antenna pattern as claimed in claim 1, the baseband processing system having an output connected to the first and the second analog mixers for providing the baseband signal to the first and the second analog mixers, and a first and a second antenna coupled to an output of the first and the second analog mixers, respectively.

9. A transmitter comprising a baseband processing system having a modulator for providing a modulated baseband signal, a phase shift controller for providing a control signal for determining a phase difference, an electronic circuit for forming an antenna pattern as claimed in claim 1, and a first and a second antenna coupled to respective outputs of the first and the second signal generators, the output of the modulator being coupled to respective modulation control inputs of the first and the second signal generators.

10. The transmitter as claimed in claim 8, wherein the phase shift controller varies the control signal in order to identify an optimized antenna pattern.

11. A method for forming an antenna pattern comprising the steps:

generating a first signal of a first frequency and of a first phase angle, by using a first control loop;

generating of a second signal of a second frequency and of a second phase angle by using a second control loop, the second frequency being substantially equal to the first frequency, selecting a phase difference between the first phase angle and the second phase angle by inputting a control current proportional to said phase difference in at least one of said first and second control loops;

mixing a first antenna signal with the first signal and mixing a second antenna signal with the second signal in the analog domain; and adding the mixed signals.

12. The method as claimed in claim 11, wherein said method further comprises varying the phase difference in order to identify an optimized antenna pattern.

13. The method as claimed in claim 11, wherein each of the first and second control loops comprises a phase-locked loop, and the method further comprises adding the control current.

* * * * *